US009440111B2

(12) United States Patent
Rutherford

(10) Patent No.: US 9,440,111 B2
(45) Date of Patent: Sep. 13, 2016

(54) DUAL CHAMBER EXERCISE DEVICE

(71) Applicant: Lamar Anthony Rutherford, Reston, VA (US)

(72) Inventor: Lamar Anthony Rutherford, Reston, VA (US)

( * ) Notice: Subject to any disclaimer, the term of this patent is extended or adjusted under 35 U.S.C. 154(b) by 2 days.

(21) Appl. No.: 14/614,589

(22) Filed: Feb. 5, 2015

(65) Prior Publication Data

US 2016/0228742 A1 Aug. 11, 2016

(51) Int. Cl.
*A63B 22/14* (2006.01)
*A63B 23/12* (2006.01)
*A63B 21/068* (2006.01)

(52) U.S. Cl.
CPC ..... *A63B 23/1236* (2013.01); *A63B 21/068* (2013.01)

(58) Field of Classification Search
USPC ..... 482/1–148
See application file for complete search history.

(56) References Cited

U.S. PATENT DOCUMENTS 4,610,448 A * 9/1986 Hill ..... A63B 23/03533 482/141
4,768,778 A * 9/1988 Thomas, Jr. ..... A63B 22/14 482/141
4,858,912 A * 8/1989 Boyd ..... A63B 23/14 482/115
7,377,888 B2 * 5/2008 Godbold ..... A63B 26/003 482/141
7,468,025 B2 * 12/2008 Hauser ..... A63B 21/00047 482/141
7,553,267 B1 * 6/2009 Hauser ..... A63B 21/00047 482/141
7,896,789 B2 * 3/2011 Hinton ..... A63B 21/00047 482/141
7,909,746 B2 * 3/2011 Gant ..... A63B 21/00047 482/141
7,935,039 B2 * 5/2011 Dannenberg ..... A63B 22/14 482/141
7,935,040 B2 * 5/2011 Moskowich ..... A63B 23/12 482/141
7,951,055 B2 * 5/2011 Mulderrig ..... A63B 21/4017 482/141
8,157,713 B1 * 4/2012 Siskowic et al. .. A63B 21/0004 482/141
9,056,222 B2 * 6/2015 Thomason ..... A63B 23/1236
9,079,092 B2 * 7/2015 Stack ..... A63B 69/004
2015/0258364 A1 * 9/2015 Hetzel ..... A63B 23/0355 482/141

* cited by examiner

*Primary Examiner* — Stephen Crow
(74) *Attorney, Agent, or Firm* — Ronald C Capossola

(57) ABSTRACT

A dual chamber device 1 for exercising is comprised of a first chamber 2, a second chamber 3 and a rotation bracket 12 connected therebetween, said device 1 can be inverted such that when positioned in a first exercise mode the exerciser can do pushups by grasping a handle bar 5 and simultaneously rotating the first chamber 2 about the second chamber 3, and in the second mode 2 the exerciser can do pushups by forming a fist and placing his/her knuckles on the knuckle pad 4 and simultaneously rotating the second chamber 3 about the first chamber 2.

6 Claims, 3 Drawing Sheets

DUAL CHAMBER EXERCISE DEVICE

CROSS REFERENCE TO RELATED APPLICATION

Priority is claimed from U.S. Provisional Application 61/965,671, filed on Feb. 6, 2014.

FEDERALLY SPONSORED RESEARCH OR DEVELOPMENT

Not applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

SEQUENCE LISTING

Not applicable

BACKGROUND OF THE INVENTION

1. Field of the Invention

This invention is concerned with the field of exercising and particularly with a device for doing pushups. Over the last 50 years, the exercise industry has exploded both with the number of people participating as well as the number of gyms and health clubs around the world. In addition to the increase in numbers and gyms, there has been an accompanying increase in the cost of club membership and exercising equipment. The present invention deals with this problem and provides for inexpensive device for exercising at home, at the office or anywhere one chooses to exercise.

2. Description of Related Art

There has been a need in the prior art to provide an inexpensive exercise device which can be used to accomplish two distinct types of exercise. Many devices have been invented over the years; e.g. exercise devices with a rotatable base, some with variable resistance and other with convex surfaces.

SUMMARY OF THE INVENTION

None of the above patents teaches the concept of a dual chamber device which gives the exerciser the ability to perform two distinct exercises by just inverting the device.

The following presents a simplified summary of the invention in order to provide a basic understanding of the many aspects of the invention.

The present invention is concerned with solving the shortcomings of the prior art set forth above.

The primary object of the present invention is to provide a dual chamber exercise device wherein the exerciser would be able to do one type of pushup and then invert the exercise device in order to do a different type of pushup.

A further object of the present invention is to provide a dual chamber exercise device having two chambers connected by a rotation bracket.

A further object of the present invention is to provide an inexpensive injection molded first and second chamber.

A further object of the present invention is to provide an exercise device for doing pushups and simultaneously rotating the chambers about each other.

A further object of the present invention is to provide an exerciser a means for doing different types of exercises by inverting the device.

A further advantage of the present invention is that the device can be used singly or in pairs.

A further advantage of the present invention is that the device can be used on an inclined surface so that the exerciser can develop different muscles in his/her upper body.

The advantages of the present invention will become apparent from the study of the following description and the accompanying drawings. It should be understood that variations may be made in the details and general features of the design concept without departing from the spirit and scope of the invention.

DETAILED DESCRIPTION OF THE DRAWINGS

Figure 1:
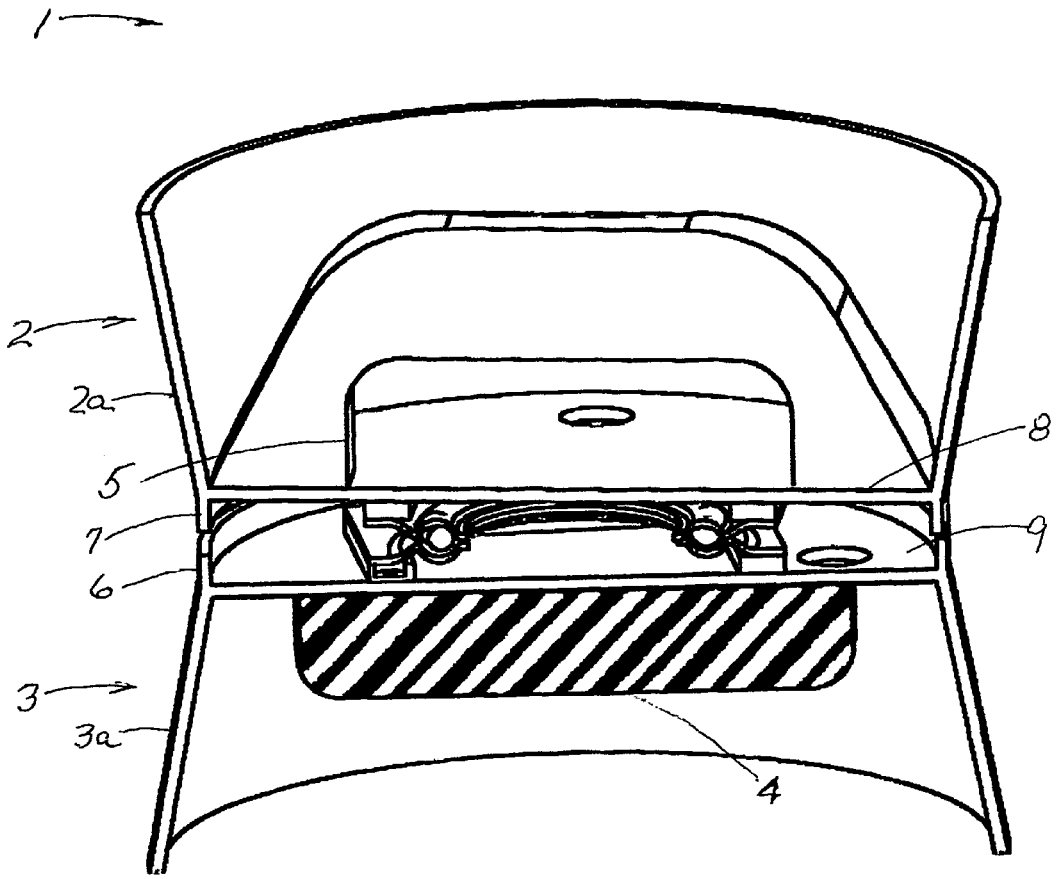
FIG. 1 is cut away view of the present invention showing a first and second chamber with a rotation bracket therebetween for connecting both chambers.

FIG. 1 shows the dual chamber exercise device 1 of the present invention including a first chamber 2 and a second chamber 3 with a rotation bracket 12 for providing rigid structural communication between first chamber 2 and second chamber 3 and allowing for the rotation of one chamber about the other. Each chamber is made of injection molded ABS plastic. It is to be understood that any material can be used in the manufacture of the present invention which provides the required structural rigidity, tensile strength and ease of manufacture. The first chamber 2 is formed with a first peripheral side wall 2*a*, a first base 8 and a first supporting ring 10 extending therefrom. Positioned within the first chamber 2 is a handle bar 5 for supporting an exerciser. The handle bar 5 is fastened to the first base 8 using screws but any type of fastener could be used. The second chamber 3 is formed with a second peripheral side wall 3*a*, a second base 9 and a second supporting ring 11 extending thereform. In addition a first circumferential wall extension 6 is formed from the first base 8 and a second circumferential wall extension 7 is formed from the second base 9. Positioned with the second chamber 3 is a knuckle pad 4 for supporting an exerciser. The knuckle pad 4 is made from any thermoplastic elastomer. The knuckle pad 4 is fastened to the second base 9 using screws but any type of fastener could be used.

Figure 2:
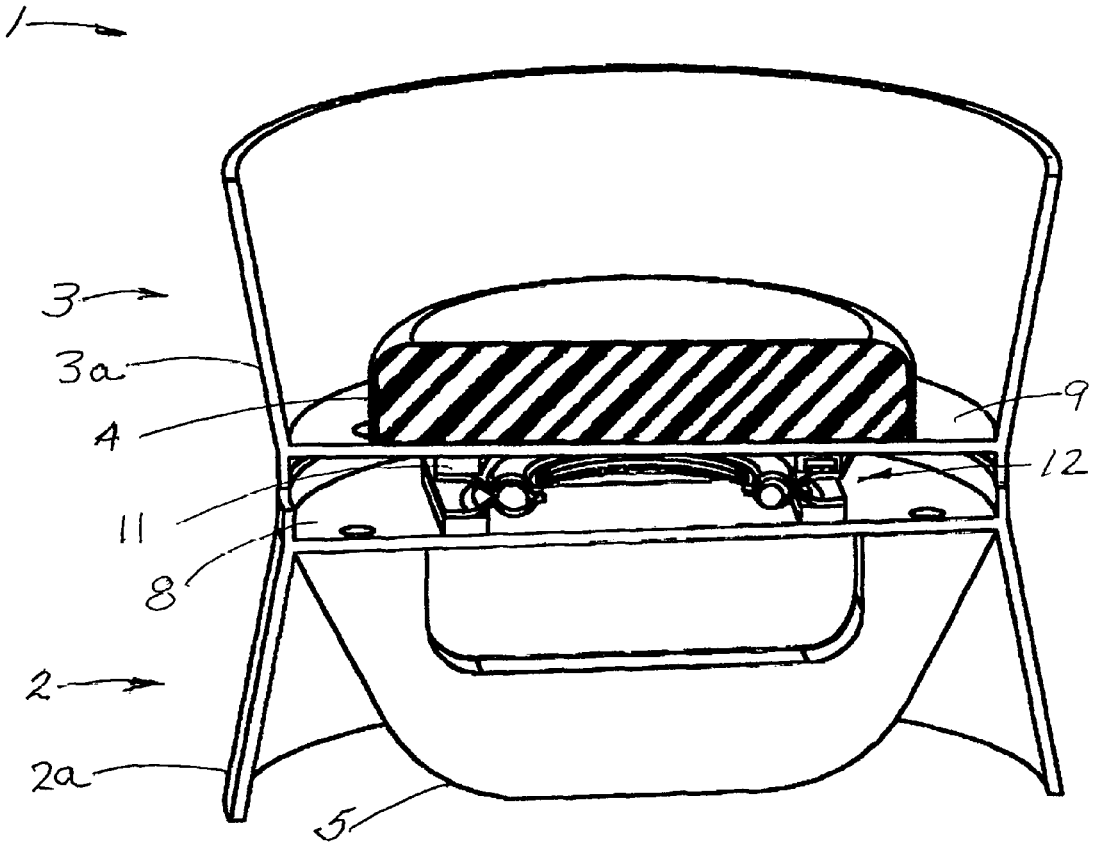
FIG. 2 is a cut away view of the present invention showing the device of FIG. 1 in the inverted position.

FIG. 2 shows the dual chamber exercise device of FIG. 1 in the inverted position with like reference numerals representing like elements of the drawings.

Figure 3:
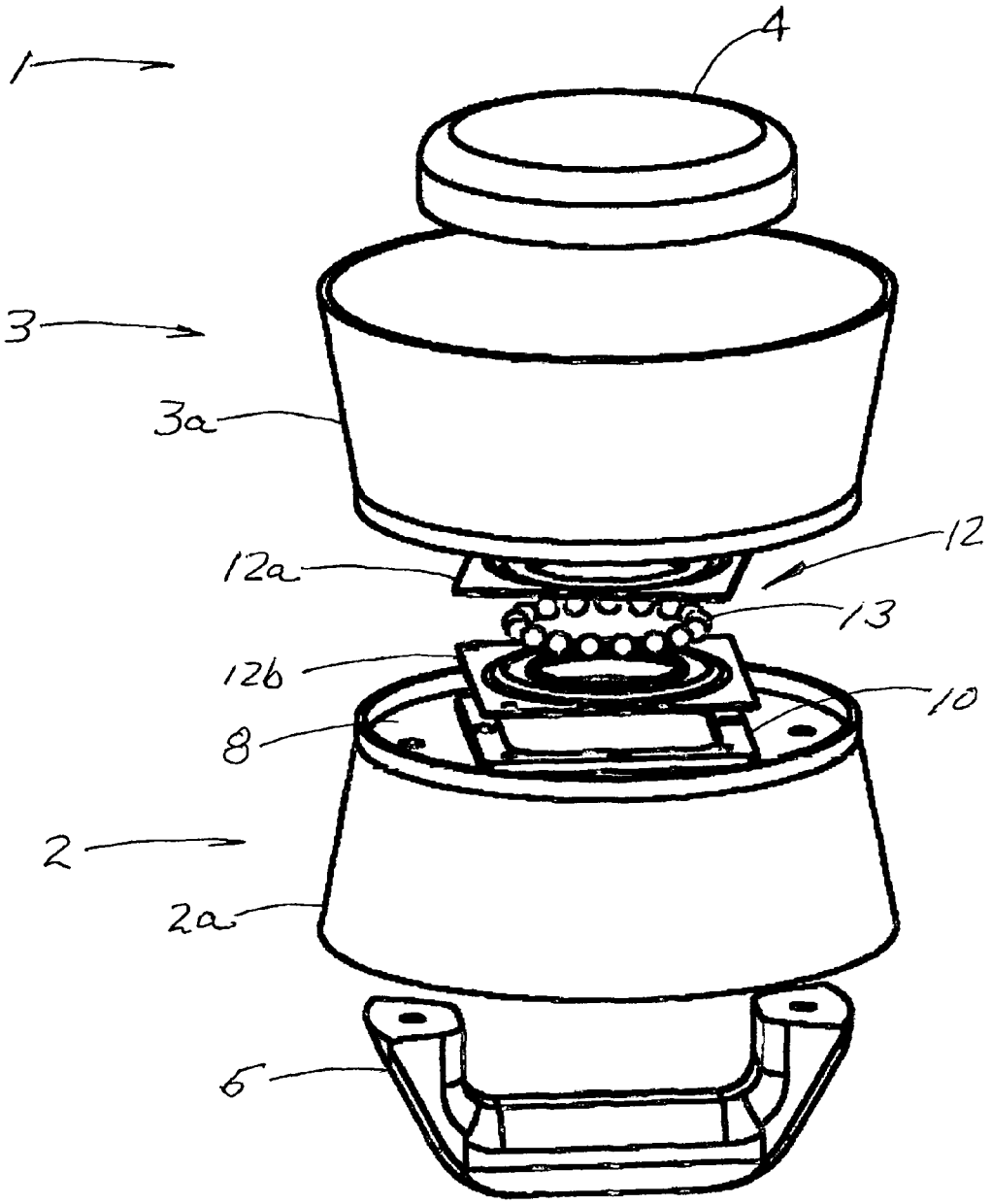
FIG. 3 is an exploded view of the present invention.

FIG. 3 is an exploded view of the present invention showing the first chamber 2, the second chamber 3 and the rotation bracket 12 having a first plate 12*a* and a second plate 12*b*. Positioned between the first 12*a* and second plate 12*b* are a plurality of ball bearings 13. The first plate 12*a* is fastened to the first supporting ring 10 and the second plate 12*b* is fastened to the second supporting ring 11 by screws or any other fastening means. The first 12*a* and second 12*b* plate of the rotation bracket 12 is made of zinc plated galvanized steel 0.9 mm thick with durable ball bearings which allow 360 degree smooth rotation.

| NUMERALS |
| --- |
| Exercise device 1 |
| First chamber 2 |
| First circumferential wall 2a |
| Second chamber 3 |
| Second circumferential wall 3b |
| Knuckle pad 4 |
| Handle bar 5 |
| First circumferential wall extension 6 |
| Second circumferential wall extension 7 |
| First base 8 |
| Second base 9 |
| First supporting ring 10 |
| Second supporting ring 11 |
| Rotation bracket 12 |
| First plate 12a |
| Second plate 12b |
| Ball bearings 13 |

Operation

The dual chamber exercise device is used in pairs with each device placed on a support surface and positioned at shoulder width of the exerciser. In a first mode, the exerciser grips the handle bars 5 and does pushups. In the second mode, the exerciser inverts the devices and places his/her knuckles on the knuckle pad 4 and does pushups. Due to the design of the devices each chamber rotates about the other chamber to maximize the results of the exercise. It is also comprehended that in an advanced work out mode, that the exerciser can place the devices at shoulder width with one device positioned for grasping the handle bar in the first chamber 2 and the other device inverted so that the exerciser can place his knuckles on the knuckle pad 4 in the second chamber.

The invention claimed is:

1. A dual chamber exercise device comprising a first and second chamber, said first chamber including a handle bar for grasping while doing pushups when the dual chamber device is in a first orientation, said second chamber including a knuckle pad for supporting an exerciser when doing knuckle pushups when the dual chamber device is in a second orientation, a rotation bracket connected between said first and second chambers for allowing rotation of the first chamber about the second chamber, said rotation bracket comprising a first and second plate with a plurality of ball bearings positioned therebetween, said first chamber including a first circumferential wall, a first base and a first supporting ring extending therefrom, said second chamber including a second circumferential wall, a second base and a second supporting ring extending therefrom wherein the first plate of the rotation bracket is attached to the first supporting ring of the first chamber and the second plate of the rotation bracket is connected to the second supporting ring of the second chamber, said handle bar and said knuckle pad being received within a recess formed by said chambers such that said chambers' circumferential walls can support the device on a support surface in either claimed orientation.

2. A method of exercising using the dual chamber exercise device of claim 1 comprising the steps of:

positioning a pair of said dual chamber exercise devices at shoulder width by supporting the dual chamber devices on a support surface in a first orientation, grasping said handle bar in each first chamber and exercise by doing pushups and rotating the first chamber about the second chamber, supporting said dual chamber devices on a support surface in a second orientation by inverting each said dual exercise device, positioning ones knuckles on said knuckle pads in each second chamber and exercise by doing knuckle pushups and rotating the second chamber about the first chamber.

3. A dual chamber exercise device comprising a first and second chamber, said first chamber including a first means for supporting an exerciser while doing pushups when the dual chamber device is in a first orientation, said second chamber including a second means for supporting an exerciser when doing pushups when the dual chamber device is in a second orientation, a rotation bracket connected between said first and second chambers for allowing rotation of the first chamber about the second chamber, said rotation bracket comprising a first and second plate with a plurality of ball bearings positioned therebetween, said first chamber including a first circumferential wall, a first base and a first supporting ring extending therefrom, said second chamber including a second circumferential wall, a second base and a second supporting ring extending therefrom wherein the first plate of the rotation bracket is attached to the first supporting ring of the first chamber and the second plate of the rotation bracket is connected to the second supporting ring of the second chamber, wherein said first and second means for supporting an exerciser being received within a recess formed by said chambers such that said chambers' circumferential walls can support the dual chamber device on a support surface in either claimed orientation.

4. The dual chamber exercise device as set forth in claim 3, wherein the first means for supporting an exerciser is a handle bar.

5. The dual chamber exercise device as set forth in claim 3, wherein the second means for supporting an exerciser is a knuckle pad.

6. A method of exercising using the dual chamber exercise device of claim 3 comprising the steps of:

positioning a pair of said dual chamber exercise devices at shoulder width by supporting the dual chamber devices on a support surface in a first orientation, using said first means for supporting the exerciser in each first chamber and exercise by doing pushups and rotating the first chamber about the second chamber, supporting said dual chamber devices on a support surface in a second orientation by inverting each said dual exercise device, using said second means in each second chamber and exercise by doing pushups and rotating the second chamber about the first chamber.

* * * * *